US006371447B1

(12) United States Patent
Imanishi et al.

(10) Patent No.: US 6,371,447 B1
(45) Date of Patent: Apr. 16, 2002

(54) CONTROL METHOD FOR HYDRAULIC-DRIVEN WINCH AND APPARATUS THEREFOR

(75) Inventors: Etsujiro Imanishi; Satoshi Yonezawa, both of Kobe; Takahiro Kobayashi, Akashi; Yoshio Nishimoto, Akashi; Taisuke Tsunoo, Akashi, all of (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/468,908

(22) Filed: Dec. 22, 1999

(30) Foreign Application Priority Data

Dec. 25, 1998 (JP) ..... 10-370477
Nov. 29, 1999 (JP) ..... 11-338746

(51) Int. Cl.[7] ..... B66D 1/00
(52) U.S. Cl. ..... 254/361; 254/377
(58) Field of Search ..... 254/361, 377

(56) References Cited

U.S. PATENT DOCUMENTS 3,764,111 A * 10/1973 Dummer ..... 254/361
4,136,855 A * 1/1979 Morrow, Sr. et al. ..... 254/361
4,187,681 A * 2/1980 Johnson ..... 254/361
4,398,698 A * 8/1983 Crawford et al. ..... 254/361
4,491,208 A * 1/1985 Burdon, Jr. ..... 254/361
5,735,506 A * 4/1998 Warnan et al. ..... 254/361
6,012,707 A * 1/2000 Enlund ..... 254/361

FOREIGN PATENT DOCUMENTS

JP 63-35555 7/1988

* cited by examiner

*Primary Examiner*—Katherine A. Matecki
(74) *Attorney, Agent, or Firm*—Oblon, Spivak, McClelland, Maier & Neustadt, P.C.

(57) ABSTRACT

According to the present invention, when a winch drum is in the wind-down rotation, operating a control valve is operated to the wind-down side in a state in which capacity of a hydraulic motor is set to small capacity by a free fall valve to thereby rotate the hydraulic motor to the wind-down side at high speeds, and at the same time, motor holding pressure is controlled according to an operating amount of the free fall valve by a holding pressure control valve to thereby regulate rotational speed of the hydraulic motor and stop the latter.

13 Claims, 11 Drawing Sheets

CONTROL METHOD FOR HYDRAULIC-DRIVEN WINCH AND APPARATUS THEREFOR

BACKGROUND OF THE INVENTION

1. Field of the Invention

The present invention relates to a control method for a hydraulic-driven winch for controlling rotation of a winch drum driven by a hydraulic motor, and apparatus therefor.

2. Description of the Related Art

Conventionally, a control apparatus for a hydraulic-driven winch is constituted, as shown in Japanese Patent Publication No. 63-35555 Publication, such that a clutch and both negative and positive brakes are provided on a winch drum, whereby ① when the drum is driven, a brake is turned off and a clutch is turned on to transmit a rotational force of a hydraulic motor, ② when the drum is stopping, the clutch is turned off and the brake is turned on to hold the drum in a stop state; and ③ in the free-fall state for freely falling a suspended load, both the clutch and the negative brake are turned off to make the winch drum free, and the drum's rotational speed is adjusted by pedal operation of the positive brake while rotating the winch drum by the weight of the suspended load.

However, in the aforementioned conventional apparatus, the clutch, the positive brake and a control system for the former are necessary for the free-fall, and as a result, the apparatus constitution becomes complicated, and the cost increases.

Further, the conventional apparatus has a disadvantage that speed adjustment of the winch drum in the free fall is accomplished by a frictional brake (a positive brake), and as a result, the brake equipment becomes larger and heavier and control of abrasion of frictional parts is necessary, for which maintenance is cumbersome.

SUMMARY OF THE INVENTION

It is an object of the present invention to provide a control method for a hydraulic-driven winch for controlling rotation of a winch drum driven by a hydraulic motor, and apparatus therefor, which requires no clutch and brake for a free fall, and which is capable of securing an excellent operation feeling by the free-fall characteristic approximate to a mechanical brake for activating speed adjusting action while moving down a suspended load by the suspended load weight.

A control method for a hydraulic-driven winch according to the present invention comprises, in a hydraulic-driven winch comprising a winch drum, a variable capacity type hydraulic motor for driving the winch drum, a hydraulic pump whose hydraulic source is the hydraulic motor, and a control valve for controlling supply and discharge of pressure oil with respect to the hydraulic motor, operating said valve to the winding-down side in a state in which capacity of said hydraulic motor is set to a small capacity when said winch drum is rotated for winding down, and adjusting motor holding pressure to thereby wind-down rotate said drum at high speed and control rotational speed.

In this case, the hydraulic motor is wind-down rotated at high speed by the wind-down operation in a state in which the motor capacity is set to a small capacity to carry out the free fall operation. Therefore, the clutch, the positive brake and the control system therefor for the free fall are unnecessary. Moreover, this is a system in which the motor holding pressure is adjusted with respect to the motor load pressure determined by the suspended load weight to obtain the brake action, that is a system for regulating the brake force according to the magnitude of load. Therefore, the suspended load moving down characteristic in the free fall is approximate to the moving down characteristic according to the conventional mechanical brake, thus enabling securing excellent operation feeling.

Further, preferably, the motor capacity is set to a small capacity, and inlet pressure of the hydraulic motor is set to low pressure.

In this case, since the inlet pressure of motor is controlled in the partial operation, the free fall operation can be carried out without trouble also in a small load, and there is no possibility that the rotational speed of motor is so high that looseness or winding disturbance of a rope occurs. In addition, the inlet pressure of motor instead of pump pressure is controlled, and therefore, in the constitution in which a single pump is used in common to a hydraulic motor for a winch drum and the other actuator, as in the case where the constitution for controlling pump pressure is employed, there occurs no evil that variation of pump pressure influences on the operation of the other actuator.

Further, a control apparatus for a hydraulic-driven winch according to the present invention for realizing the above method comprises a winch drum, a variable capacity type hydraulic motor for driving the winch drum, a hydraulic pump as hydraulic source for the hydraulic motor, a control valve for controlling supply and discharge with respect to the hydraulic motor, a control valve operating means for operating the control valve, a motor capacity control means for controlling capacity of the hydraulic motor, a free fall instructing means for instructing a small motor capacity to the motor capacity control means, and a motor holding pressure control means for controlling motor holding pressure in wind-down rotation of the hydraulic motor.

Further, preferably, the motor holding pressure control means is operatively connected to operation of the motor capacity control means according to the instructions from the free fall instructing means.

Further, preferably, there is provided a motor inlet pressure control valve for controlling inlet pressure of the hydraulic motor in the wind-down rotation of the winch drum.

Further, preferably, the motor inlet pressure control valve is operatively connected to operation of the motor capacity control means according to instructions from the free fall instructions means to control the motor inlet pressure.

Further, preferably, a variable relief valve is connected to a damper chamber of a counterbalance valve provided in a wind-up side pipeline of the hydraulic motor, and relief pressure of the variable relief valve is set to be low when the hydraulic motor begins to actuate, and to be high during rotation.

Further, preferably, a hydraulic pilot type relief valve is used as the variable relief valve, and motor inlet pressure is taken out and guided to pilot port of the variable relief valve whereby relief pressure of the variable relief valve is set to be low at the time of high pressure corresponding to the beginning of actuation of motor, and to be high at the time of low pressure corresponding to the during rotation of motor.

Further, preferably, a hydraulic pilot type relief valve is used as the variable relief valve, pressure corresponding to the operating amount of the control valve to the wind-down side is taken out and guided to the pilot port of the variable relief valve whereby relief pressure of the variable relief valve is set to be low when the operating amount is small, and to be high when the operating amount is large.

In this case, a variable relief valve is connected to a damper chamber of a counterbalance valve, and relief pressure (damper pressure) of the variable relief valve is set to be low when the hydraulic motor begins to actuate and to be high during rotation, that is, the relief pressure is set according to the motor inlet pressure or the operating amount. Therefore, it is possible to prevent occurrence of hunting while in the beginning of actuation, rising a pressure difference between a pilot pressure chamber of the counterbalance valve and the damper chamber to improve respondence, and lowering the pressure difference during rotation of motor.

Further, preferably, a restrictor is provided parallel to the motor inlet pressure control valve.

In this case, it is possible to suppress variation of motor inlet pressure small by the restrictor.

Further, preferably, a flow-rate control valve for limiting motor flow-rate less than discharge flow-rate of hydraulic pump is provided in a motor wind-up side pipeline.

In this case, the motor flow-rate can be limited less than the pump discharge flow-rate by the flow-rate control valve provided in the motor wind-up side pipeline (a motor outlet side pipeline when the free fall is operated). Because of this, even if the damper effect is deteriorated, it is possible to prevent hunting, and to be compatible the respondence with the stability.

Further, preferably, there is provided a wind-up side pressure detection means for detecting pressure of the wind-up side pipeline of the hydraulic motor, and the motor capacity control means increases the motor capacity as wind-up side pipeline pressure detected by the wind-up side pressure detection means is higher.

In this case, when in the free fall, load is great and pressure on the motor wind-up side is high, that is, where motor rotational speed is excessively high, since the wind-up side pressure is detected to increase the motor capacity, the motor rotational speed automatically lowers.

Further, preferably, as the motor capacity control means, an actuator for regulating motor capacity for varying capacity of the hydraulic motor, and an actuator control valve for actuating the actuator are provided, and as the free fall instructions means, a free fall valve for actuating the actuator between a large motor capacity position and a small motor capacity position through the actuator control valve.

Further, preferably, as the control valve, a hydraulic pilot type switching valve is used, and as the control valve operating means, a wind up side and wind down side remote control valve for supplying pilot pressure to the hydraulic pilot type switching valve is used, the free fall valve being connected to a pilot pressure line of the wind-down side remote control valve through a high pressure selection valve.

In this case, when the free fall valve is operated, the motor capacity is set to small capacity, and at the same time, the control valve is switched to the wind-down side. That is, the free fall operation is carried out merely by operation of the free fall valve. Therefore, as compared with the case where operation of the control valve to the wind-down side and switching of the motor capacity are separately carried out, the free fall operation is simple to prevent erroneous operation.

Furthermore, preferably, as the control valve, a hydraulic pilot type switching valve is used, and as the control valve operating means, a windup side and wind-down side remote control valve for supplying pilot pressure to the hydraulic pilot type switching valve is used, and a switching valve switched between a position for controlling only the control valve and a position for controlling both the control valve and the actuator is provided in the pilot pressure line of the wind-down side remote control valve so that the wind-down side remote control valve serves as the free fall valve.

In this case, since the wind-down remote control valve serves as the free fall valve, the whole cost can be suppressed.

DESCRIPTION OF THE PREFERRED EMBODIMENTS

The embodiments of the present invention will be described hereinafter with reference to the drawings.

FIRST EMBODIMENT

Figure 1:
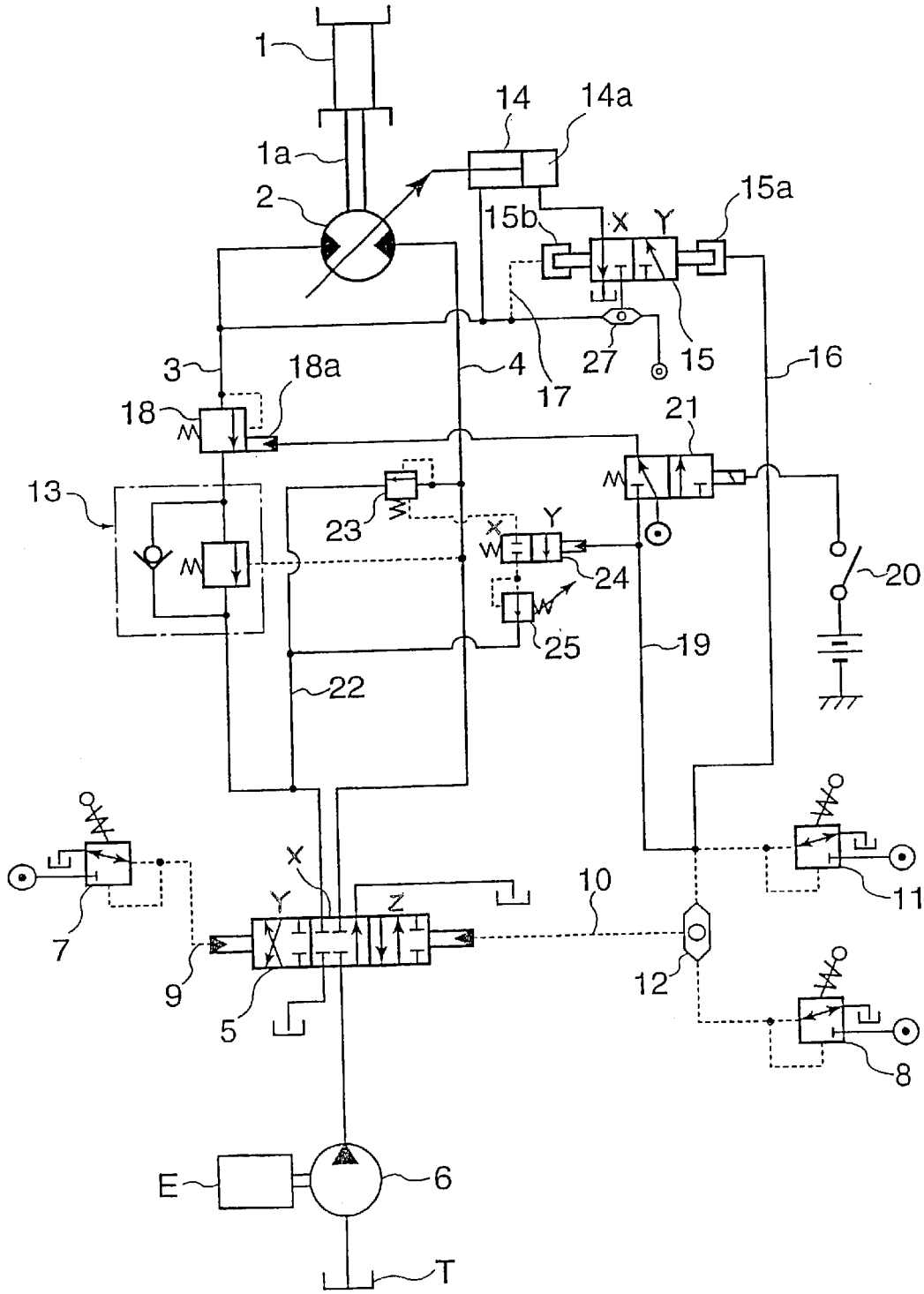
FIG. 1 is a hydraulic circuit view showing a first embodiment of the present invention.

A first embodiment will be described with reference FIGS. 1 and 2. In FIG. 1, numeral 1 designates a winch drum. A rotational shaft 1*a* of the winch drum 1 is connected to a hydraulic motor 2 for a variable capacity type winch directly or through a reduction gear, and the winch drum 1 is rotated and driven by the motor 2.

Both wind-up side and wind-down side pipelines 3 and 4 constituting a drive circuit of the motor 2 are connected to a hydraulic pump 6 through a hydraulic pilot switching type control valve 5 provided with three positions X, Y and Z, i.e., neutral, wind-up and wind-down, and supply and discharge of pressure oil to the motor 2 (rotational direction and speed in drive and stop) with respect to the motor 2 is controlled by the valve 5.

Numeral 7 designates a wind-up side remote control valve for operating the valve 5 to the wind-up side, and numeral 8 designates a wind-down side remote control valve for operating the valve 5 to the wind-down side in the normal wind-down, and pilot pressure according to operating amount of both the remote control valves 7 and 8 is fed to wind-up side and wind-down side pilot ports 5*a* and 5*b* of both valves 5 by pilot pressure lines 9 and 10.

The wind-down side remote control valve 8 is connected to the valve 5 through a shuttle valve (a high pressure selection valve) 12 in a state parallel to a free fall valve 11 as a hydraulic remote control valve, and the valve 5 is operated by pilot pressure on the side on which the remote control valve 8 or a relief valve 11 is operated.

Numeral 13 designates a counterbalance valve as a brake valve for generating hydraulic brake force in a wind-up side pipeline 3 in the power wind-down rotation, and letter E designates an engine for driving the hydraulic pump 6.

A motor capacity control means for controlling capacity of the hydraulic motor 2 will be described below.

Numeral 14 designates a cylinder as a motor capacity regulating actuator (hereinafter called a capacity regulating cylinder) for varying motor capacity by varying a tilt angle of the hydraulic motor 2, and the motor 2 is set to a large capacity in a state in which the cylinder 14 is contracted as shown, and set to a small capacity in a state in which the cylinder is extended.

An extended side oil chamber 14*a* of the cylinder 14 is connected to a wind-up side pipeline 3 or a pad hydraulic source through a cylinder control valve (an actuator control valve) 15 of a hydraulic pilot switching type and a shuttle valve 27.

The cylinder control valve 15 has a large capacity position X and a small capacity position Y, and at the large capacity position X, the extended side oil chamber 14*a* of the cylinder 14 comes in communication with a tank T so that the cylinder 14 contracts (the motor 2 is set to a large capacity).

On the other hand, when the cylinder control valve 15 is switched to the small capacity position Y, oil in the wind-up side pipeline 3 or the pilot hydraulic source is introduced into the extended side oil chamber 14*a* of the cylinder whereby the cylinder 14 extends (the motor 2 is set to a small capacity).

A motor capacity switching line 16 is connected to a small capacity side pilot port 15*a* of the cylinder control valve 15, the line 16 being connected to the free fall valve 11.

On the other hand, a large capacity side pilot port 15*b* of the cylinder control valve 15 is connected to the wind-up side pipeline 3 by a wind-up side pressure detection line 17, and when pressure of the pipeline 3 becomes high, the cylinder control valve 15 is operated to the large capacity position X to increase the motor capacity.

Pressure control means for controlling motor holding pressure and motor inlet side pressure in the free fall operation will now be described.

A holding pressure control valve 18 as a hydraulic pilot type pressure control valve is provided in the wind-up side pipeline 3 to be a motor outlet side pipeline in the motor wind-down rotation, and a pilot port 18*a* of the control valve 18 is connected to the free fall valve 11 through a holding pressure control line 19.

Thereby, set pressure of the control valve 18, that is, motor holding pressure in the free fall operation (pressure against pressure adapted to rotate the motor 2) is controlled by the valve 11.

Figure 2:
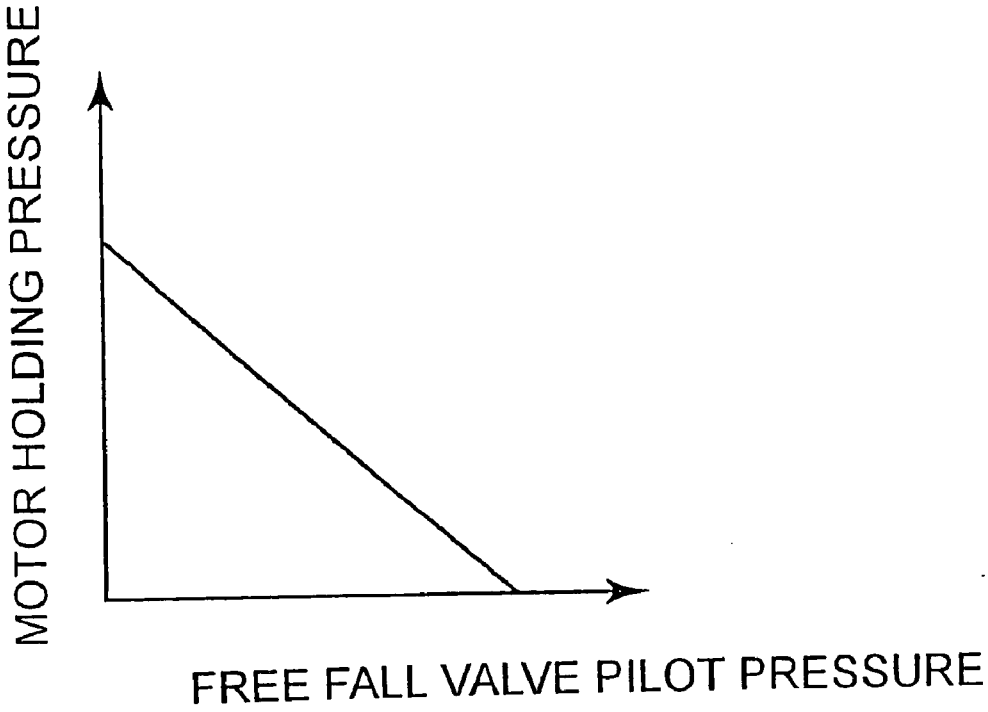
FIG. 2 is a view showing a relationship between pilot pressure and motor holding pressure from a free fall valve according to the first embodiment.

A relationship between pilot pressure (operating amount) of the valve 11 and motor holding pressure is set as shown in FIG. 2, and the motor holding pressure lowers in proportional to the operating amount of the valve 11.

An electromagnetic switching valve 21 controlled by a switch 20 is provided in the holding pressure control line 19, and in the normal wind-down operation (when the switch 20 is off), high pilot pressure from the hydraulic source is fed to the holding pressure control valve 18 through the switching valve 21.

Thereby, set pressure of the control valve 18 is set to the minimal value, and the normal wind-down operation is carried out without trouble.

On the other hand, a bypass pipeline 22 is provided between the wind-up side pipe line 3 (in FIG. 1, between the counterbalance valve 13 and the control valve 5) and the wind-down side pipeline 4, and a motor inlet pressure control valve 23 for controlling motor inlet pressure in the free fall operation is provided in the pipeline 22.

A spring side pressure port of the control valve 23 is connected to the pipeline 22 (wind-up pipeline 3) through an inlet pressure switching valve 24 as a hydraulic pilot type and a pressure setting valve 25.

A pilot port of the switching valve 24 is connected to the free fall valve 11 through the holding pressure control line 19, and in the free fall operation, the inlet pressure switching valve 24 s switched from the closed position X to the open position Y by the pilot pressure from the valve 11.

Thereby, set pressure of the motor inlet pressure control valve 23 (motor inlet pressure) is set to a value determined by the set pressure of the pressure setting valve 25.

In the following, operation of this apparatus will be explained.

In the normal wind-up and wind-down operations, the free fall valve 11 is not operated but the wind-up side or wind-down side remote control valve 7 or 8 is operated.

At that time, the motor capacity is set to large capacity, and the motor inlet pressure is set to high pressure, and the motor 2 is rotated at speeds according to the operating amount of the wind-up or wind-down remote control valve 7 or 8 (stroke of the control valve 5) to carry out the normal wind-up or wind-down operation.

On the other hand, when the free fall operation is carried out, the free fall valve 11 is operated.

By doing so, the motor capacity is set to small capacity, and the motor inlet pressure is set to low pressure.

The motor holding pressure set by the holding pressure control valve 18 lowers according to the operating amount of the free fall valve 11 in accordance with the characteristic of FIG. 2, and when the force adapted to wind-down rotate the motor 2 (load pressure determined by the suspended load weight+motor inlet pressure) exceeds the motor holding pressure, the holding pressure control valve 18 is opened so that the motor 2 starts the wind-down rotation.

At that time, since the motor capacity is set to small capacity, the motor 2 wind-down rotates at high speeds to carry out the free fall operation.

Further, since the motor holding pressure changes according to the operating amount of the free fall valve 11, the operating amount of the valve 11 is adjusted according to the load, whereby the brake force, that is, the rotational speed of the motor 2 (free fall speed) can be suitably adjusted to stop the rotation of the motor 2.

As described above, since the motor 2 is set to small amount to thereby obtain the free fall function, the clutch and the positive brake for the free fall, and the control system therefor are unnecessary.

Moreover, because of the system for obtaining the brake action by adjusting the motor holding pressure (pressure for stopping the motor) by the free fall valve 11, with respect to the motor wind-down rotating force determined by the suspended load weight and the motor inlet pressure, that is, the system for adjusting the brake force according to the size of loads, operating feeling is approximate to operating feeling obtained by the conventional mechanical brake.

Further, since the motor capacity is set to small capacity, and at the same time, the motor inlet pressure is controlled by the motor inlet pressure control valve 23, the motor inlet pressure is controlled according to loads whereby even if load is small, the free fall operation can be carried out without trouble.

Further, it is possible to carry out operation closer to the original free fall free from possibility that the motor rotational speed becomes excessively high so that looseness and disturbance of winding of a rope occur.

Moreover, since the motor inlet pressure not the motor pressure is controlled, in the constitution in which a single pump is used in common to the motor 2 and the other actuator, as in the case of employing the constitution in which the pump pressure is controlled, there occurs no evil that the operation of the other actuator is affected by the variation of pump pressure.

In this case, due to the employment of constitution in which the motor inlet pressure control valve 23 is provided in the bypass pipeline 22 for short-circuiting between both the pipelines 3 and 4 to take the motor outlet side pressure into the spring side pressure chamber of the control valve 23 via the pressure setting valve 25 and the pressure switching valve 24, even if variation should occur in pressure on the motor outlet side for some reason (for example, where return oil is restricted by the control valve 5), it is possible to take the variation portion into the control valve 23 to maintain a pressure difference between the before and the behind of the motor 2 constant.

SECOND EMBODIMENT

Figure 3:
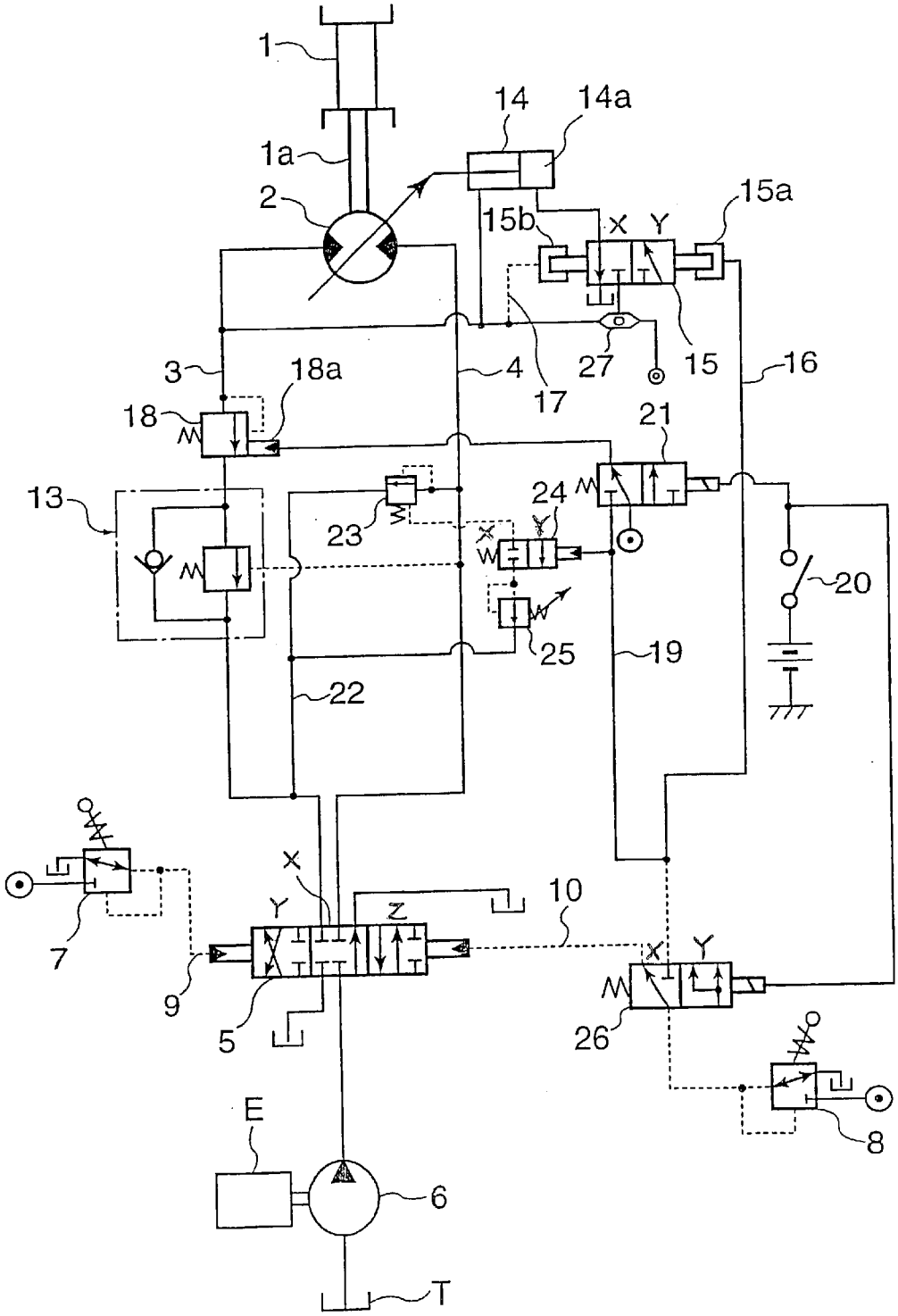
FIG. 3 is a hydraulic circuit view showing a second embodiment of the present invention.

Only the difference from the first embodiment will be described with reference to FIG. 3.

Since switching between the normal wind-down operation and the free fall operation is carried out by selecting the remote control valve 8 or the free fall valve 11, it is easy to distinguish the wind-down operation from the free fall operation as recognition of an operator, whereas use of two valves 8 and 11 results in high cost.

On the other hand, in the second embodiment, the wind-down remote control valve 8 is used in common to the normal wind-down operation and the free fall operation in order to reduce the cost.

That is, a mode switching valve (an electromagnetic switching valve) 26 controlled simultaneously with the electromagnetic switching valve 21 by the switch 20 is provided on the secondary side of the wind-down side remote control valve 8, and when the switching valve 26 is switched from a normal wind-down position (a position for controlling only the control valve 5) X shown to a free fall position on the right hand (a position for simultaneously controlling the valve 5, the capacity adjusting cylinder 14 and the holding pressure control valve 28) Y, the free fall operation is carried out.

When the constitution is employed in which in the free fall operation, the motor inlet pressure is set to low pressure by the motor inlet pressure control valve 23 as described above, the following problem occurs.

The counterbalance valve 13 provided in the motor wind-up side pipeline 3 performs the function of preventing cavitation during winding-down.

The counterbalance valve 13 is provided with a pilot pressure chamber 13*b* for taking pressure of the wind-down pipeline 4 as pilot pressure to pressurize a spool 13*a* in an opening direction, and a damper chamber (a spring side pressure chamber) 13*c* resisting thereto.

The damper chamber 13*c* is provided with a restrictor 13*d*, and an opening degree of the restrictor 13*d* is set to thereby make the respondence in the free fall operation (when the motor inlet pressure becomes high, valve opens quickly) compatible with the stability (no hunting). In this case, since an opening degree of the restrictor 13*a* is set with the normal wind-down operation as a reference, when the motor inlet pressure is set to low pressure in the free fall operation, a difference between the pilot pressure of the counterbalance valve 13 and the damper pressure is small, because of which the valve 13 is hard to open, deteriorating the respondence.

To prevent this, it is contemplated that an opening degree of the restrictor 13*d* is set to be large to lower the damper effect, and the valve opening pressure is set to be low.

However, the stability is deteriorated as an evil, and particularly, hunting occurs in which when load is large, opening and closing of the counterbalance valve 13 is repeated due to the variation of the motor inlet pressure.

From the foregoing, in the following third to fifth embodiments, excellent compatibility between the respondence and the stability in the free fall operation is attempted.

THIRD EMBODIMENT

Figure 4:
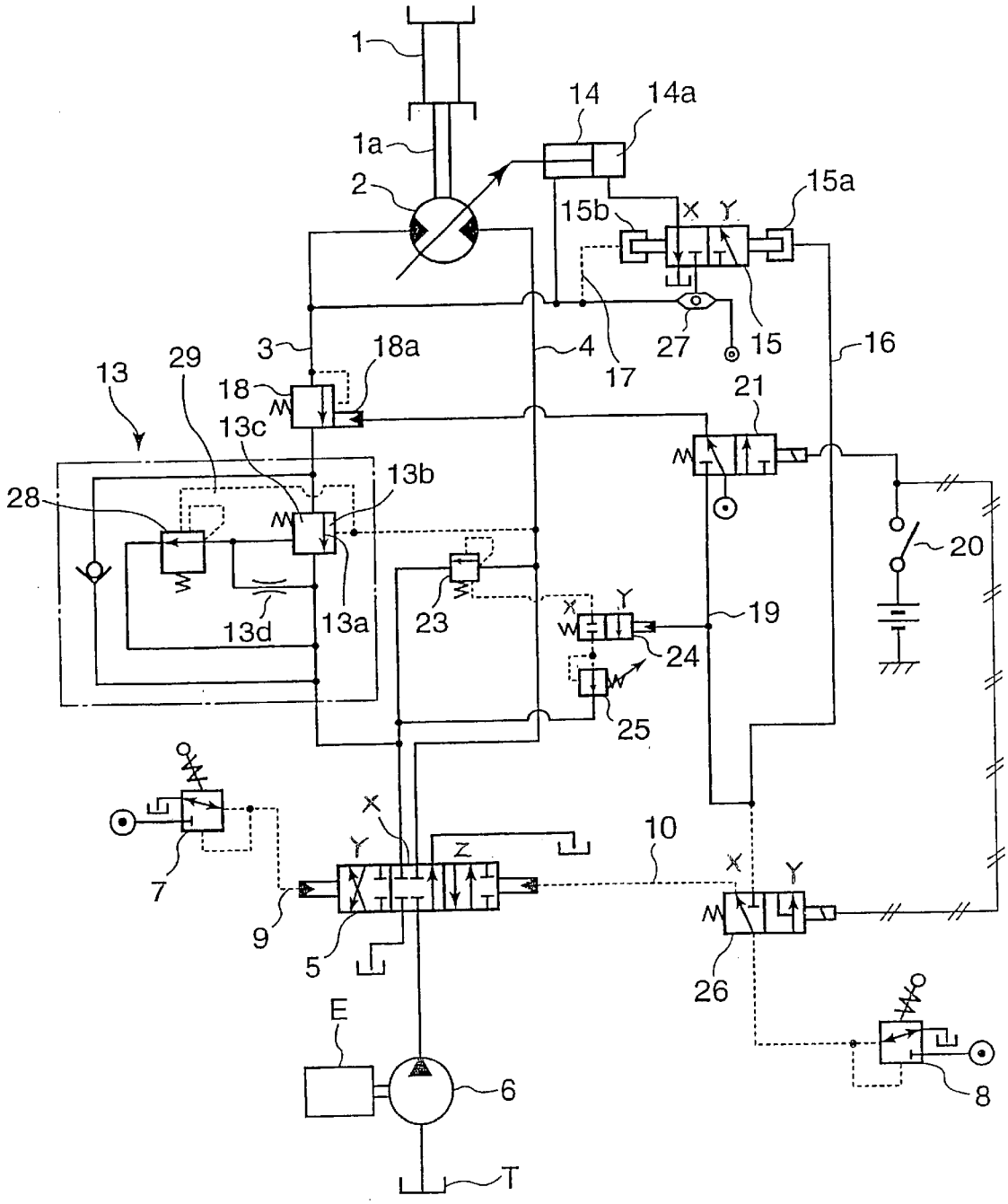
FIG. 4 is a hydraulic circuit view showing a third embodiment of the present invention.
Figure 5:
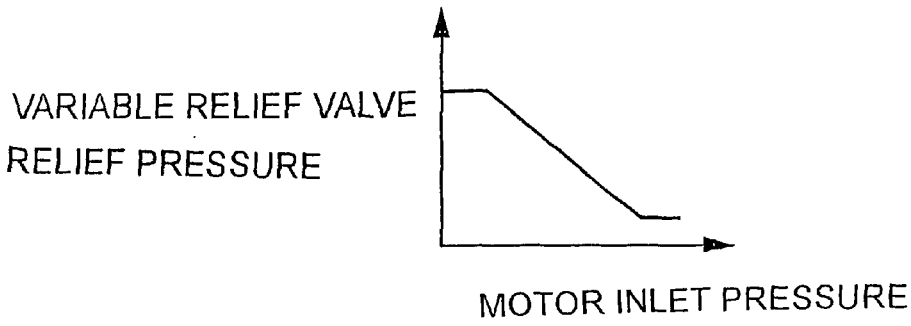
FIG. 5 is a view showing a relationship between motor inlet pressure and relief pressure of a variable relief valve provided on a counterbalance valve according to the third embodiment.

A third embodiment will be described with reference to FIGS. 4 to 6. A variable relief valve 28 is connected parallel to a restrictor 13*d* to a damper chamber 13*c* of a counterbalance valve 13, and relief pressure of the relief valve 28 is set to be low when the motor begins its operation and to be high during rotation thereof.

That is, a pilot line 29 for guiding pilot pressure to the variable relief valve 28 is connected to the wind-down side pipeline 4, and motor inlet pressure in the free fall operation is introduced into a pilot port of the valve 28 through the line 29 whereby the relief pressure of the vale 28 is controlled by the motor inlet pressure.

The motor inlet pressure and the relief pressure of the valve 28 are substantially in a relation of inverse proportion, so that when the motor inlet pressure becomes high, the relief pressure is set to low pressure, and when the motor inlet pressure becomes low, the relief pressure is set to high pressure.

Figure 6:
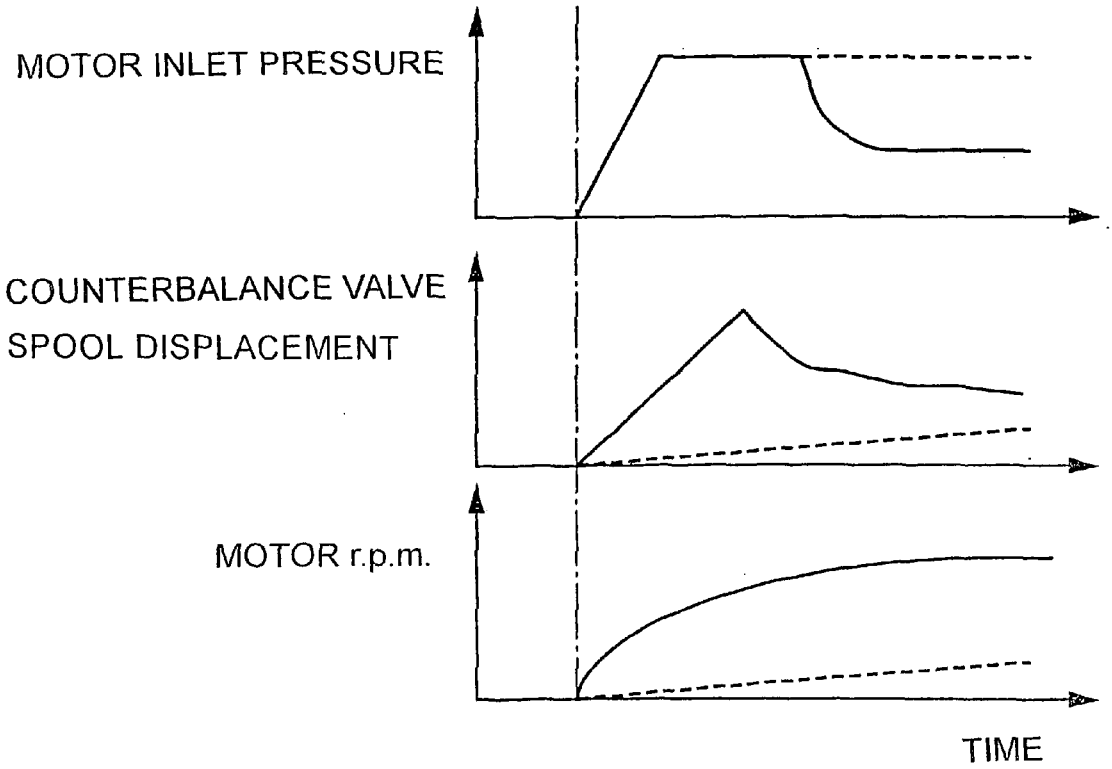
FIG. 6 is a view showing the behavior of the motor inlet pressure or the like according to the third embodiment.

Accordingly, as shown in FIG. 6, when the motor 2 begins its operation in the free fall operation, the motor inlet pressure becomes high pressure so that the relief pressure of the relief valve 28 is set to low pressure, and therefore, a pressure difference between the pilot pressure chamber 13*b* of the counterbalance valve 13 and the damper chamber 13*c* is large, as a result of which the spool 13*a* is easy to open. That is, the excellent respondence is secured.

When the rotation of motor comes close to a standing state so that the motor inlet pressure begins to lower, the relief pressure of the relief valve 28 becomes high conversely to the former, and the pressure difference between the pilot pressure chamber 13*b* and the damper chamber 13*c* of the counterbalance valve 13 is small so that the spool 13*a* is hard to operate. That is, the stability of the valve 13 is improved.

In this manner, also in the free fall operation, compatibility between the excellent respondence and stability of the counterbalance valve 13 can be attained.

FOURTH EMBODIMENT

Figure 7:
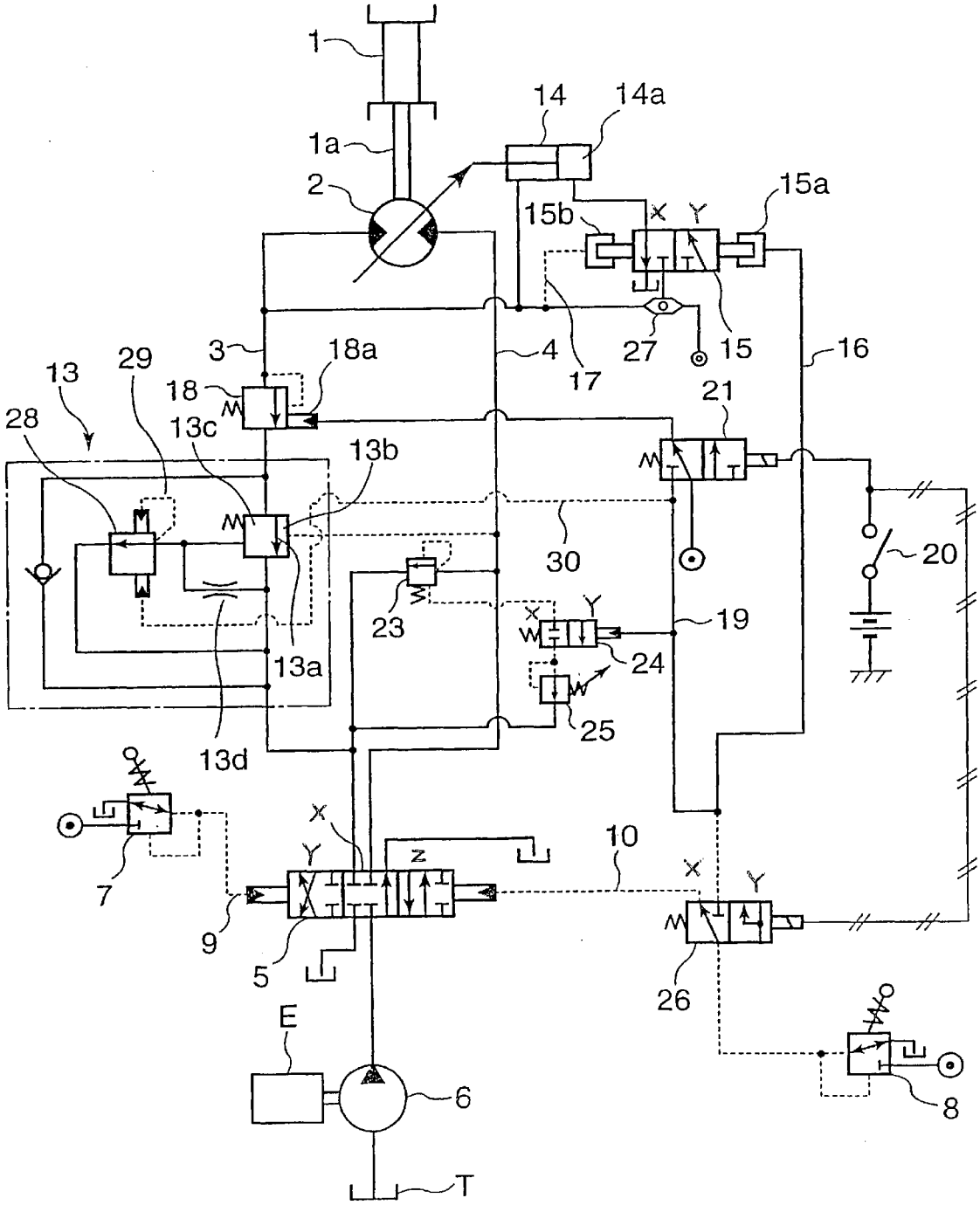
FIG. 7 is a hydraulic circuit view showing a fourth embodiment of the present invention.
Figure 8:
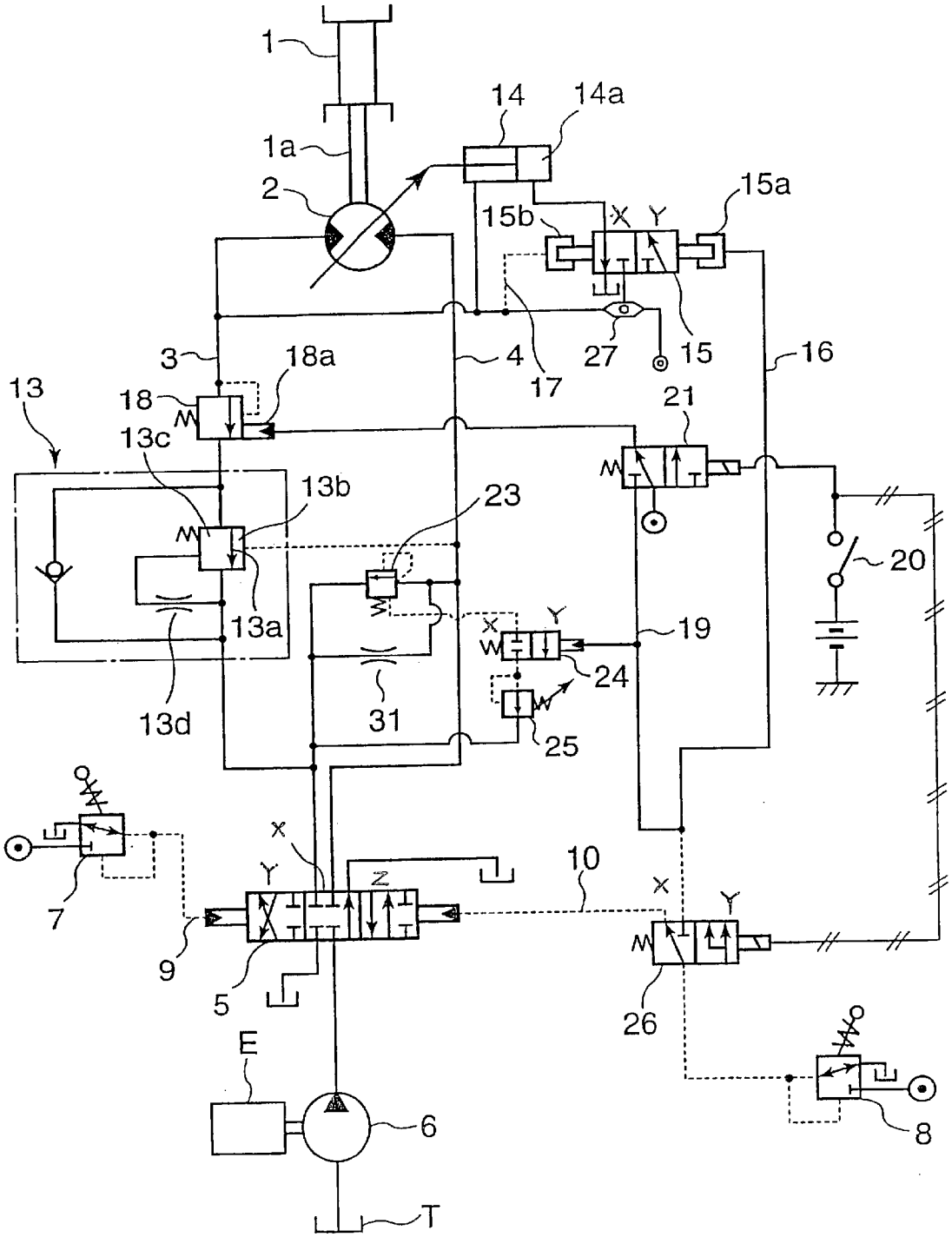
FIG. 8 is a hydraulic circuit view showing a fifth embodiment of the present invention.

A fourth embodiment will be described with reference to FIG. 7. In the third embodiment, the relief pressure of the variable relief valve 28 provided in the counterbalance valve 13 is controlled according to the motor inlet pressure, whereas in the fourth embodiment, the relief pressure of the valve 28 is controlled according to the operating amount of the wind-down side remote control valve 8.

That is, in the present embodiment, a double pilot type relief valve into which pilot pressure is introduced is provided as a valve also on the spring side, a holding pressure control line 19 in which pressure proportional to the operating amount of the wind-down remote control valve 8 is generated is connected to a spring side pilot port of the valve 28 through a pilot line 30.

Accordingly, the relief pressure of the relief valve 28 is set to low pressure in a region where the operating amount of the remote control valve 8 is shallow (remote control pressure is low at the beginning of operation of the motor 2), and is set to high pressure in a region where the operating amount of the valve 8 is deep (remote control pressure is high when the motor comes dose to standing rotation).

Thereby, the operation and effect similar to those of the third embodiment can be obtained.

FIFTH EMBODIMENT

A fifth embodiment will be described with reference to FIGS. 8 to 11.

When an opening degree of the restrictor 13*d* connected to the damper chamber of the counterbalance valve 13 is set to be large to lower the set pressure of the valve 13, the respondence at the beginning of operation of motor can be improved.

Figure 9:
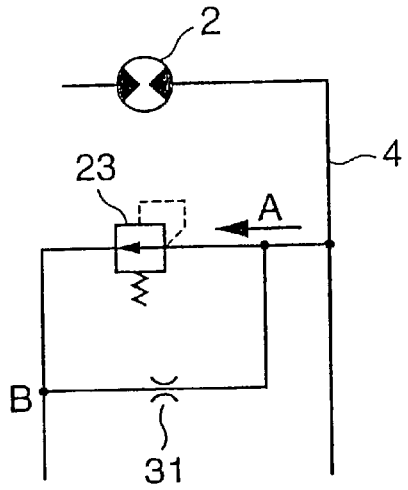
FIG. 9 is a partly enlarged view of FIG. 8.
Figure 10:
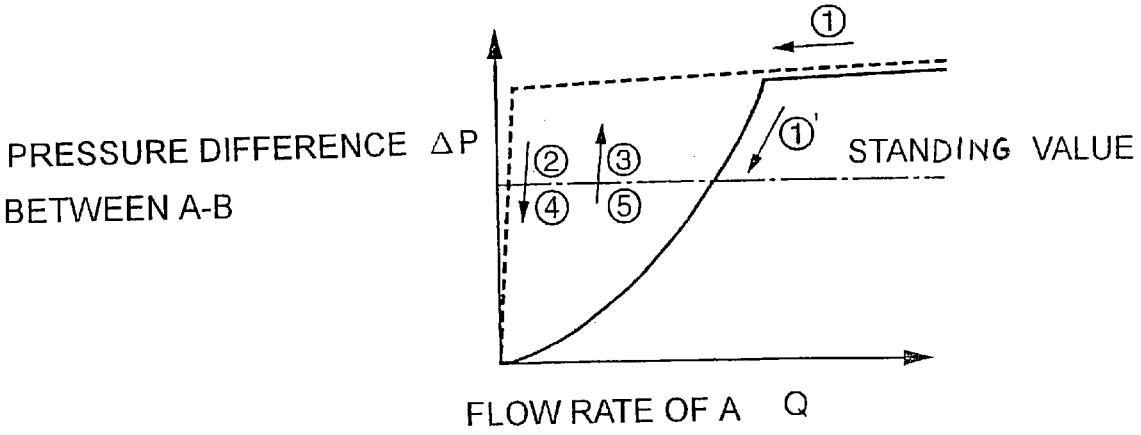
FIG. 10 is a view showing a relationship between inlet side flow-rate of a motor inlet pressure control valve and a pressure difference according to the fifth embodiment.

However, when particularly, at a large load, the motor 2 is pulled by the load so that flow-rate in excess of pump discharge flow-rate flows, flow-rate Q flowing through the control valve 23 approaches 0 as indicated by the dotted line in FIG. 10 so that a pressure difference ΔP between an inlet side A and an outlet side B of the control valve 23 shown in FIG. 9 rapidly lowers.

That is, when the flow-rate Q approaches Q, the pressure difference ΔP shifts from ① to ② as indicated by the dotted line, and the portion ② is large in change of ΔP, which exceeds the standing value. Because of this, the counterbalance valve 13 is rapidly closed, and the motor inlet pressure again rises as shown in ③, after which the valve 13 begins to open. As a result, the motor inlet pressure again lowers as shown in ④, falling into a hunting state in which the behavior similar to that mentioned above is repeated thereafter.

Thus, in this form, a restrictor 31 is provided parallel with the motor inlet pressure control valve 23.

By doing so, since the variation of motor inlet pressure is absorbed by the restrictor 31, when the solid line in FIG. 10, that is, the flow-rate Q approaches 0, it passes from ① to ①', and at that time, inclination is gentle as compared with the case of the dotted line in the figure thus not resulting in a hunting state to enable realization of a stabilized system.

Figure 11:
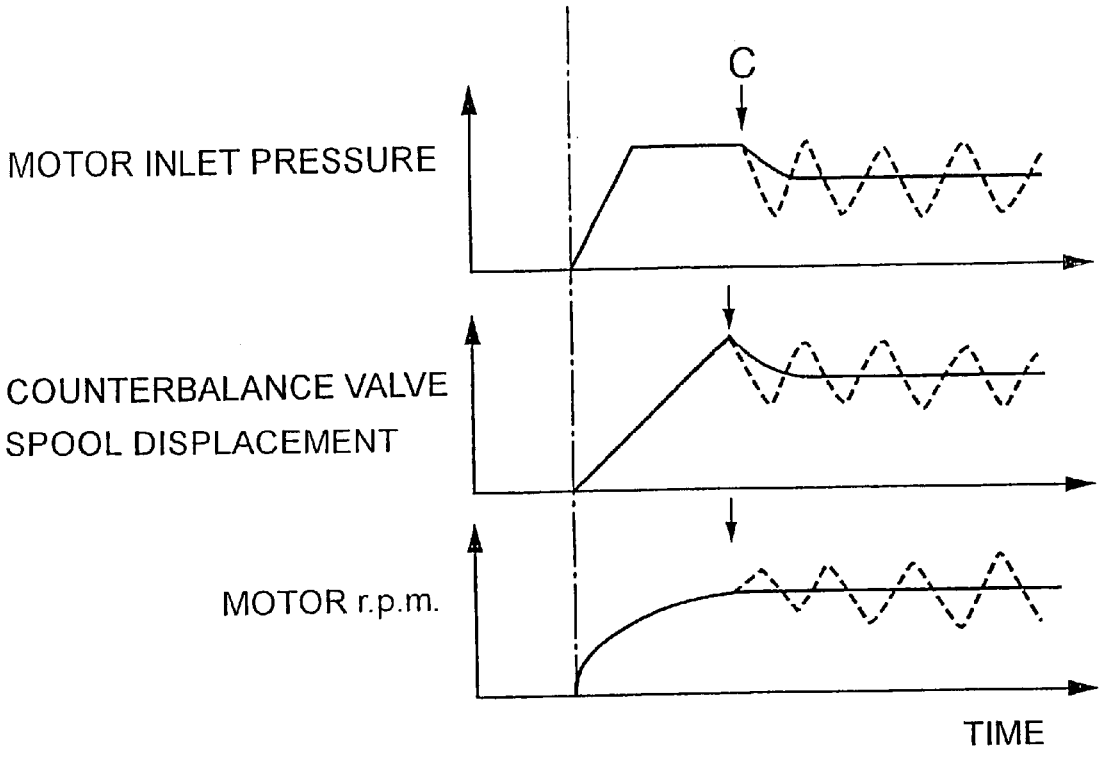
FIG. 11 is a view showing the behavior of the motor inlet pressure or the like according to the fifth embodiment.

FIG. 11 shows the behaviors in various parts at the beginning of operation of a winch. The motor inlet pressure is raised by the wind-down operation so that the motor 2 starts to operate. However, where the restrictor 31 is not provided, the motor input pressure rapidly starts to change from point C as indicated by the dotted line in the figure, assuming a hunting state.

On the other hand, when the restrictor 31 is provided, the change of the motor inlet pressure from the point C is gentle, thus shifting to the standing state in a stable manner.

SIXTH EMBODIMENT

Figure 12:
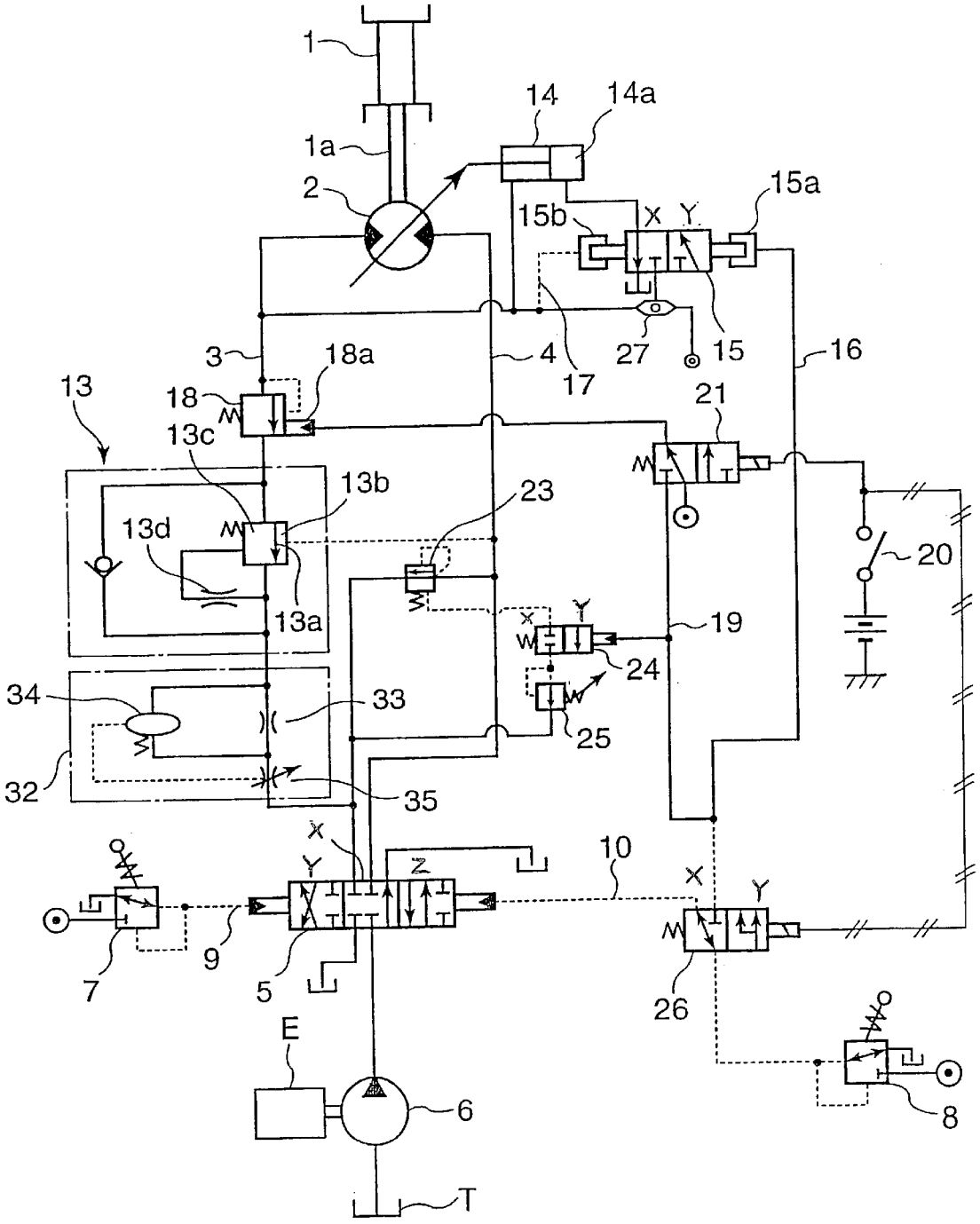
FIG. 12 is a hydraulic circuit view showing a sixth embodiment of the present invention.

A sixth embodiment will be described with reference to FIGS. 12 to 14. In the sixth embodiment, as a separate means for achieving the same object of the fifth embodiment, a flow-rate control valve 32 for maintaining the motor flow-rate less than the pump discharge flow-rate is provided on the wind-up side pipeline 3.

The control valve 32 comprises a fixed restrictor 33, and a variable restrictor 35 whose opening degree varies in association with the movement of a spool 34.

In the control valve 32, a pressure difference when the passage flow-rate of the restrictor 33 reaches the pump discharge flow-rate is obtained from the pump discharge flow-rate and an opening area of the fixed restrictor 33, and the spring characteristic of the spool 34 is set on the basis of the pressure difference whereby:

(i) as the passage flow-rate of the fixed restrictor 33 increases, the opening area of the variable restrictor 35 is small, and (ii) when the passage flow-rate reaches the pump discharge flow-rate, the opening area is 0.

Figure 13:
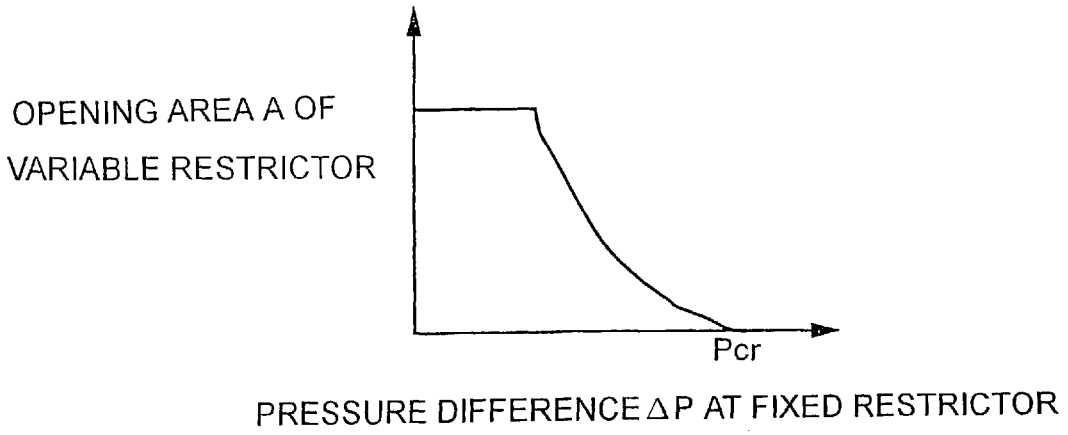
FIG. 13 is a view showing a relationship between a pressure difference at a fixed restrictor of a flow-rate control valve and an opening area of a variable restrictor according to the sixth embodiment.

FIG. 13 shows one example of a relationship between the opening area A of the variable restrictor 35 and the pressure difference ΔP.

Assuming that Q denotes the pump discharge flow-rate, the fact that the passage flow-rate of the fixed restrictor 33 is Q means that the motor flow-rate is Q, and if the opening area of the variable restrictor 35 is set as described above, the opening degree of the restrictor 35 becomes small as the motor flow-rate comes closer to the discharge flow-rate Q.

In this case, since the flow-rate passing through the restrictor 35 reduces, and the motor flow-rate does not exceed the pump discharge flow-rate, it is possible to prevent hunting of the counterbalance valve 13.

Figure 14:
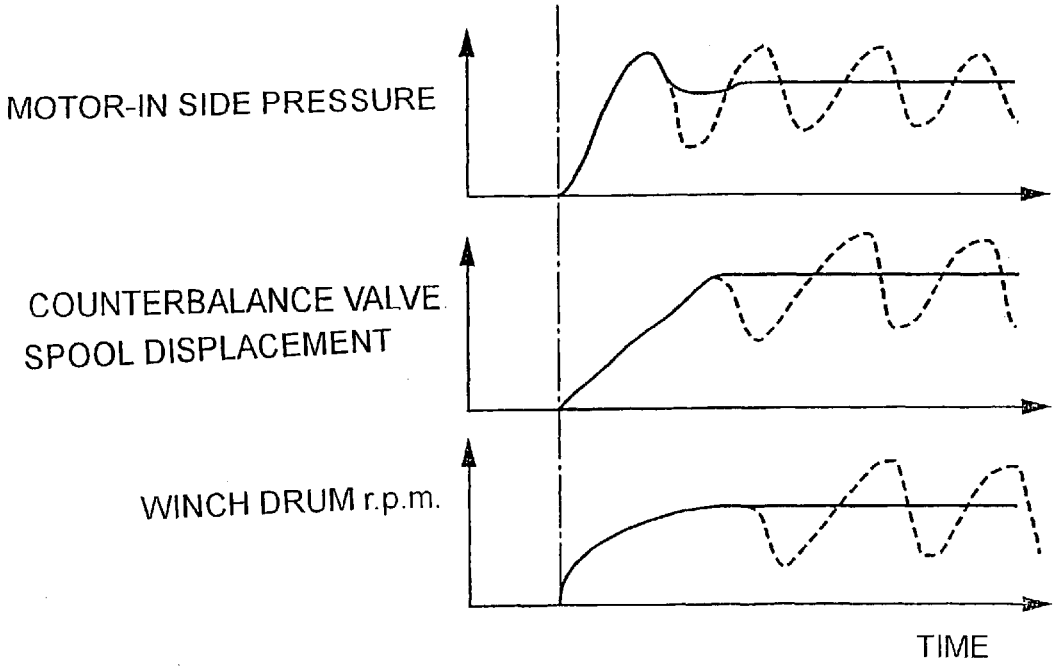
FIG. 14 is a view showing the behavior of the motor inlet pressure or the like according to the sixth embodiment.

FIG. 14 shows the behavior of various parts at the beginning of operation of the motor, in which the motor inlet pressure is risen by the wind-down operation so that the motor 2 begins to rotate. Where the flow-rate control valve 32 is not provided, the motor inlet pressure rapidly changes as indicated by the dotted line to assume a hunting state, whereas in the present embodiment, the change of the motor inlet pressure is gentle, shifting to the standing state in a stable manner, similar to the case of the fifth embodiment (see FIG. 11).

OTHER EMBODIMENT (1) As motor capacity control means, a motor and a motor control circuit for controlling the former may be used in place of the capacity adjusting cylinder 14 and the cylinder control valve 15 used in the above described embodiments.

(2) As a control valve, an electromagnetic pilot type or manual type switching valve may be used in place of the hydraulic pilot type switching valve used in the above-described embodiment.

Here, the control valve operating means serves as an electric circuit for outputting an electric signal when the electromagnetic pilot type switching valve is used, and serves as an operating lever when the manual type switching valve is used.

(3) As the inlet pressure switching valve 24 constituting the inlet pressure control means, an electromagnetic type or manual type switching valve may be used in place of the hydraulic pilot type in the above described embodiment.

We claim:

1. A control method for a hydraulic driven winch comprising a winch drum, a variable capacity hydraulic motor driving said winch drum, a hydraulic pump connected as a hydraulic source for said hydraulic motor, and a control valve for controlling supply and discharge of pressure oil to and from said hydraulic motor, said method comprising the steps of:

setting said control valve to a wind down position of said winch drum;

reducing the capacity of said hydraulic motor; and controlling a rotational speed of said winch drum by controlling a holding pressure of said motor.

2. The control method of claim 1, wherein said step of controlling a rotational speed of said winch drum comprises reducing an inlet pressure of said hydraulic motor.

3. A control apparatus in a hydraulic driven winch comprising a winch drum, a variable capacity hydraulic motor driving said winch drum and a hydraulic circuit including a hydraulic pump connected as a hydraulic source for said hydraulic motor, comprising:

a control valve controlling a supply and discharge of pressure oil to and from said hydraulic motor such that said hydraulic motor selectively winds-up and winds-down the winch drum;

a motor capacity controller for the variable capacity hydraulic motor;

a motor holding pressure control valve in said hydraulic circuit; and means for setting said motor capacity controller to reduce the capacity of the variable capacity hydraulic motor when said control valve is set to wind-down the winch drum.

4. The apparatus of claim 3, further comprising means, operatively connected to said means for setting said motor capacity controller, for controlling said motor holding pressure control valve to set a motor holding pressure.

5. The control apparatus for a hydraulic-driven winch according to claim 4, further comprising:

a variable relief valve connected to a damper chamber of a counterbalance valve provided in a wind-up pipeline of said hydraulic motor, in which relief pressure of said variable relief valve is set to be low at a beginning of operation of the hydraulic motor, and to be high during rotation thereof.

6. The control apparatus for a hydraulic-driven winch according to claim 5, wherein said variable relief valve comprises a hydraulic pilot type relief valve, in which an inlet pressure of the motor is taken out and guided to a pilot port of said variable relief valve whereby relief pressure of the variable relief valve is set to be low at a time corresponding to the beginning of operation of the motor, and to be high at a time corresponding to the during rotation of the motor.

7. The control apparatus for a hydraulic-driven winch according to claim 5, wherein said variable relief valve comprises a hydraulic pilot type relief valve, in which a pressure corresponding to an operating amount to the wind-down side of the control valve is taken out and guided to a pilot port of said variable relief valve whereby a relief pressure of the variable relief valve is set to be low when the operating amount is small, and to be high when the operating amount is large.

8. The control apparatus for a hydraulic-driven winch according to claim 4, wherein a restrictor is provided in parallel with an inlet pressure of said motor.

9. The control apparatus for a hydraulic-driven winch according to claim 4, further comprising:

a flow-rate control valve provided in the motor wind-up pipeline, whereby a motor flow-rate is limited to be less than a discharge flow-rate of the hydraulic pump.

10. The control apparatus for a hydraulic-driven winch according to claim 4, further comprising:

a wind-up side pressure detection means for detecting pressure of said wind-up side pipeline of the hydraulic motor, wherein the motor capacity control means increases the capacity of said motor as the pressure of the wind-up side pipeline detected by said wind-up side pressure detection means increases.

11. The control apparatus for a hydraulic-driven winch according to claim 10, wherein as said motor capacity control means comprises an actuator for regulating motor capacity for changing capacity of the hydraulic motor and an actuator control valve for operating said actuator, further comprising a free fall valve for operating said actuator between a large motor capacity position and a small motor capacity position through said actuator control valve.

12. The control apparatus for a hydraulic-driven winch according to claim 11, wherein as said control valve, a hydraulic pilot type switching valve is used, and as said control valve operating means, a wind-up side and wind-down side remote control valve for supplying pilot pressure to said hydraulic pilot type switching valve is used, the free fall valve being connected to a pilot pressure line of the wind-down side remote control valve through a high pressure selection valve.

13. The control apparatus for a hydraulic-driven winch according to claim 11, wherein as said control valve, a hydraulic pilot type switching valve is used, and as said control valve operating means, a wind-up side and wind-down side remote control valve for supplying pilot pressure to said hydraulic pilot type switching valve is used, and there is provided a switching valve switched between a position for controlling only the control valve and a position for controlling both the control valve and the actuator in the pilot pressure line of the wind-down side remote control valve so that the wind-down side remote control valve serves as a free fall valve.

* * * * *